US011226094B2

(12) United States Patent
Mu et al.

(10) Patent No.: US 11,226,094 B2
(45) Date of Patent: Jan. 18, 2022

(54) BURNERS AND METHODS FOR USE THEREOF

(71) Applicant: Beijing Zhongyu Topsun Energy Technology Co., Ltd., Beijing (CN)

(72) Inventors: Ruili Mu, Changchun (CN); Tongzhou Tu, Beijing (CN)

(73) Assignee: Beijing Zhongyu Topsun Energy Technology Co., Ltd., Beijing (CN)

( * ) Notice: Subject to any disclaimer, the term of this patent is extended or adjusted under 35 U.S.C. 154(b) by 117 days.

(21) Appl. No.: 16/827,568

(22) Filed: Mar. 23, 2020

(65) Prior Publication Data

US 2020/0224872 A1 Jul. 16, 2020

Related U.S. Application Data

(63) Continuation of application No. PCT/CN2018/107015, filed on Sep. 21, 2018, which (Continued)

(51) Int. Cl.
*F23D 14/64* (2006.01)
*F23D 99/00* (2010.01)

(52) U.S. Cl.
CPC ..... *F23D 14/64* (2013.01); *F23D 91/00* (2015.07)

(58) Field of Classification Search
CPC ..... F23D 14/22; F23D 14/58; F23D 14/02; F23D 14/62; F23D 14/48; F23D 91/00; F23D 11/40
See application file for complete search history.

(56) References Cited

U.S. PATENT DOCUMENTS 5,675,971 A 10/1997 Angel et al.
6,565,361 B2 * 5/2003 Jones ..... F23C 6/047 438/6

(Continued)

FOREIGN PATENT DOCUMENTS

CN 1675500 A 9/2005
CN 106500096 A 3/2017

(Continued)

OTHER PUBLICATIONS

European search report and opinion dated Mar. 24, 2021 for EP Application No. 18859487.3.

*Primary Examiner* — David J Laux
*Assistant Examiner* — Nikhil P Mashruwala
(74) *Attorney, Agent, or Firm* — Wilson Sonsini Goodrich & Rosati

(57) ABSTRACT

Systems, methods, and devices are provided herein for burners. In one aspect, a burner is provided comprising at least one air pipe; at least one fuel pipe; a plurality of groups of mixing units disposed at a downstream end of the burner, wherein each of the plurality of groups of mixing units is arranged coaxially and adjacent to one another, and each group of mixing units comprises at least one fuel channel connected to the at least one fuel pipe and at least one air channel connected to the at least one air pipe, wherein an outlet of the at least one fuel channel and an outlet of the at least one air channel are angled at a certain degree relative to one another such that the fuel flowing out of the outlet of the at least one fuel channel is mixed with the air flowing out of the outlet of the at least one air channel, thereby achieving multiple-stage mixing of the air and fuel.

18 Claims, 10 Drawing Sheets

Related U.S. Application Data is a continuation of application No. PCT/CN2017/103135, filed on Sep. 25, 2017.

(56) References Cited

U.S. PATENT DOCUMENTS

| | | | | |
|---|---|---|---|---|
| 7,244,119 | B2 * | 7/2007 | Chung | F23D 14/70 431/116 |
| 7,303,388 | B2 * | 12/2007 | Joshi | F23D 14/22 239/601 |
| 10,227,922 | B2 * | 3/2019 | Whelan | F02C 7/228 |
| 2009/0241942 | A1 | 10/2009 | Schwank et al. | |

FOREIGN PATENT DOCUMENTS

| | | | |
|---|---|---|---|
| DE | 10005256 | A1 | 8/2001 |
| EP | 0943863 | A1 | 9/1999 |
| EP | 1445466 | A2 | 8/2004 |
| EP | 1893915 | A1 | 3/2008 |
| EP | 2442026 | A1 | 4/2012 |
| GB | 1565247 | A | 4/1980 |
| WO | WO-2010073156 | A1 | 7/2010 |
| WO | WO-2019057166 | A1 | 3/2019 |

* cited by examiner

BURNERS AND METHODS FOR USE THEREOF

CROSS-REFERENCE

This application is a continuation application of International Application No. PCT/CN2018/107015 filed on Sep. 21, 2018, which claims priority from PCT Application No. PCT/CN2017/103135 which was filed on Sep. 25, 2017, the content of which is hereby incorporated by reference in its entirety.

BACKGROUND

Embodiments of the present disclosure relate generally to burners and methods for use thereof.

Industrial furnaces can be used for a wide variety of processes, such as petroleum cracking, metal raw material melting, raw material sintering and heat treatment, or the like. These furnaces may have a burner as a core component for providing the heat to the furnaces using combustible fuels as energy sources. The burner may consist of a number of combustion units of the same type, each of which can generate combustion independent of other combustion units. The combustion conditions of combustion units are crucial for energy saving. The air supply nozzles of combustion units of the traditional industrial furnaces are generally arranged in parallel with the fuel nozzles. Therefore, the fuel (or gas fuel) and air are discharged in the same direction from the nozzles in front of the respective pipes, resulting in mixture of the fuel and air outside a combustion head of the burner. A main drawback of this structure is inadequate mixture of the air and fuel, leading to insufficient combustion of fuel. Further, thermal efficiency of the combustion fuel is relatively low and the exhaust fuel discharged from the furnace has high nitrogen content, which may not only cause a waste of energy but also pollute the environment.

SUMMARY

A need exists for improved burners capable of adequate mixing, energy saving, and having reduced pollution to the environment. The burners herein may have multiple-stage mixing units arranged at a downstream portion of the burners. Each of the multiple-stage mixing units may include at least one fuel channel connected to at least one fuel pipe of the burner and at least one air channel connected to at least one air pipe of the burner. An outlet of the at least one fuel channel and an outlet of the at least one air channel may be angled at a certain angle relative to one another such that the fuel discharged from the outlet of the fuel channel can be sufficiently mixed with the air discharged from the outlet of the air channel. The air flow velocity of the air channel can be configured to be greater than the fuel flow velocity of the fuel channel such that a negative pressure can be generated at a mixing location of the air and fuel. The negative pressure generated in this way may draw more fuel discharged from the outlet of the fuel channel, thereby increasing the fuel-to-air ratio in the mixture while making the resulting mixture more uniform. The multiple-stage mixing at the outlets of the air and fuel channels, along with further mixing of those mixtures within a central mixing chamber, is advantageous in preventing the flashback and burnout that tends to occur in conventional burners due to excessive mixing.

According to one aspect of the present disclosure, a burner is provided. The burner can comprise: at least one air pipe; at least one fuel pipe; a plurality of groups of mixing units disposed at a downstream end of the burner, wherein each of the plurality of groups of mixing units is arranged coaxially and adjacent to one another, and each group of mixing units comprises at least one fuel channel connected to the at least one fuel pipe and at least one air channel connected to the at least one air pipe, wherein an outlet of the at least one fuel channel and an outlet of the at least one air channel are angled relative to one another such that fuel flowing out of the outlet of the at least one fuel channel is mixed with air flowing out of the outlet of the at least one air channel, thereby achieving multiple-stage mixing of the air and the fuel.

In some embodiments, the plurality of groups of mixing units can be disposed vertically along a central longitudinal axis of the burner.

In some embodiments, each group of mixing units can comprise a plurality of fuel channels, a plurality of air channels or a combination thereof.

In some embodiments, the plurality of groups of mixing units can comprise a first group of mixing units and a second group of mixing units.

In some embodiments, the first group of mixing units and the second group of mixing units can be arranged on a firing plate with three stages, and the three stages can comprise a first stage, a second stage and a third stage.

In some embodiments, the first group of mixing units can comprise a first plurality of air channels arranged on the first stage of the firing plate and a first plurality of fuel channels arranged on the second stage of the firing plate, and a central longitudinal axis of each of the first plurality of air channels can be angled relative to a central longitudinal axis of a corresponding one of the first plurality of fuel channels.

In some embodiments, the central longitudinal axis of each of the first plurality of air channels can be angled relative to the central longitudinal axis of the corresponding one of the first plurality of fuel channels ranging from approximately 45 degrees to 120 degrees.

In some embodiments, the central longitudinal axis of each of the first plurality of air channels can be angled relative to the central longitudinal axis of the corresponding one of the first plurality of fuel channels at approximately 90 degrees.

In some embodiments, the first plurality of air channels can be arranged circumferentially around the first stage of the firing plate.

In some embodiments, the first plurality of air channels can be evenly-spaced around a periphery of the first stage of the firing plate.

In some embodiments, the first plurality of air channel can be unevenly spaced around a periphery of the first stage of the firing plate.

In some embodiments, the first plurality of fuel channels can be arranged to be radially outwardly extended from a central longitudinal axis of the burner body.

In some embodiments, the number of the first plurality of fuel channels can be proportional or disproportional to the number of the first plurality of air channels.

In some embodiments, the number of the first plurality of fuel channels can be equal to the number of the second plurality of air channels.

In some embodiments, a cross section of an outlet of each of the first plurality of air channels can be circular and a radius of the outlet can be equal to a vertical distance of a bottom surface of the air channel to an outer edge of the second stage of the firing plate.

In some embodiments, the second group of mixing units can comprise a second plurality of air channels arranged on the second stage of the firing plate and a second plurality of fuel channels arranged on the third stage of the firing plate, and a central longitudinal axis of each of the second plurality of air channels can be angled relative to a central longitudinal axis of a corresponding one of the second plurality of fuel channels.

In some embodiments, the central longitudinal axis of each of the second plurality of air channels can be angled relative to the central longitudinal axis of the corresponding one of the second plurality of fuel channels at a degree ranging from approximately 45 degrees to 120 degrees.

In some embodiments, the central longitudinal axis of each of the second plurality of air channels can be angled relative to the central longitudinal axis of the corresponding one of the second plurality of fuel channels at approximately 90 degrees.

In some embodiments, each of the second plurality of air channels can be arranged to be a passage passing through the first and second stages of the firing plate to connect with the at least one air pipe.

In some embodiments, the second plurality of fuel channels can be arranged circumferentially around a periphery of the third stage of the firing plate.

In some embodiments, the number of the second plurality of fuel channels can be proportional or disproportional to the number of the second plurality of air channels.

In some embodiments, the number of the second plurality of fuel channels can be equal to the number of the second plurality of air channels.

In some embodiments, a cross section of an outlet of each of the second plurality of fuel channels can be circular and a radius of the outlet can be equal to a vertical distance of a bottom surface of each air channel on the second stage to an outer edge of the third stage of the firing plate.

In some embodiments, the plurality of groups of mixing units can comprise a first group of mixing units, a second group of mixing units and a third group of mixing units.

In some embodiments, the first group of mixing units, the second group of mixing units and the third group of mixing units can be arranged on a firing plate with three stages, and wherein the three stages can comprise a first stage, a second stage and third stage.

In some embodiments, the first group of mixing units can comprise a first plurality of air channels arranged on the first stage of the firing plate and a first plurality of fuel channels arranged on the second stage of the firing plate, and a central longitudinal axis of each of the first plurality of air channels can be angled relative to a central longitudinal axis of a corresponding one of the first plurality of fuel channels.

In some embodiments, the central longitudinal axis of each of the first plurality of air channels can be angled relative to the central longitudinal axis of the corresponding one of the first plurality of fuel channels at a degree ranging from approximately 45 degrees to 120 degrees.

In some embodiments, the central longitudinal axis of each of the first plurality of air channels can be angled relative to the central longitudinal axis of the corresponding one of the first plurality of fuel channels at approximately 90 degrees.

In some embodiments, the first plurality of air channels can be arranged circumferentially around the first stage of the firing plate.

In some embodiments, the first plurality of air channels can be evenly-spaced around a periphery of the first stage of the firing plate.

In some embodiments, the first plurality of air channel can be unevenly spaced around a periphery of the first stage of the firing plate.

In some embodiments, the first plurality of fuel channels can be arranged to be radially outwardly extended from a central longitudinal axis of the burner body.

In some embodiments, the number of the first plurality of fuel channels can be proportional or disproportional to the number of the first plurality of air channels.

In some embodiments, the number of the first plurality of fuel channels can be equal to the number of the second plurality of air channels.

In some embodiments, a cross section of an outlet of each of the first plurality of air channels can be circular and a radius of the outlet can be equal to a vertical distance of a bottom surface of the air channel to an outer edge of the second stage of the firing plate.

In some embodiments, the second group of mixing units can comprise a second plurality of air channels arranged on the second stage of the firing plate and a second plurality of fuel channels arranged on the third stage of the firing plate, and a central longitudinal axis of each of the second plurality of air channels can be angled relative to a central longitudinal axis of a corresponding one of the second plurality of fuel channels.

In some embodiments, the central longitudinal axis of each of the second plurality of air channels can be angled relative to the central longitudinal axis of the corresponding one of the second plurality of fuel channels at a degree ranging from approximately 45 degrees to 120 degrees.

In some embodiments, the central longitudinal axis of each of the second plurality of air channels can be angled relative to the central longitudinal axis of the corresponding one of the second plurality of fuel channels at approximately 90 degrees.

In some embodiments, each of the second plurality of air channels can be arranged to be a passage passing through the first and second stages of the firing plate to connect with the at least one air pipe.

In some embodiments, the second plurality of fuel channels can be arranged circumferentially around a periphery of the third stage of the firing plate.

In some embodiments, the number of the second plurality of fuel channels can be proportional or disproportional to the number of the second plurality of air channels.

In some embodiments, the number of the second plurality of fuel channels can be equal to the number of the second plurality of air channels.

In some embodiments, a cross section of an outlet of each of the second plurality of fuel channels is circular and a radius of the outlet can be equal to a vertical distance of a bottom surface of each air channel on the second stage to an outer edge of the third stage of the firing plate.

In some embodiments, the third group of mixing units can comprise a first plurality of air channels arranged on the third stage of the firing plate and a first plurality of fuel channels arranged on the second stage of the firing plate, and a central longitudinal axis of each of the first plurality of fuel channels can be angled relative to a central longitudinal axis of a corresponding one of the first plurality of gas channels.

In some embodiments, the first plurality of air channels of the third group of mixing units can be replaced by the at least one fuel pipe or a portion thereof at the center of the burner body.

In some embodiments, the second plurality of fuel channels of the third group of mixing units can be arranged annularly around the inner surface of the third stage.

In some embodiments, the central longitudinal axis of the each of second plurality of fuel channels can be angled relative to the central longitudinal axis of the burner body at an acute angle.

In some embodiments, the central longitudinal axis of the each of second plurality of fuel channels can be angled relative to the central longitudinal axis of the burner body at an angel selected from a range from 30 degrees to 90 degrees.

In some embodiments, a total sectional area of the air channels on the first stage of the firing plate can account for approximately 50%~80% of a total sectional area of all the air channels on the three stages of the firing plate.

In some embodiments, the total sectional area of the air channels on the first stage of the firing plate can account for approximately 60% of the total sectional area of all the air channels on the three stages of the firing plate.

In some embodiments, the burner can further comprise a burner housing configured to encompass the plurality of groups of mixing units inside of the burner.

In some embodiments, the burner can further comprise a convergent nozzle arranged ahead of the plurality of groups of mixing units, and the convergent novel can be configured to converge a flame generated at a mixing zone and eject it out of the burner.

In some embodiments, a convergence angel of the convergent nozzle with respect to the central longitudinal axis of the burner body can range from 20 degrees to 70 degrees.

In some embodiments, refractory material can be filled between an outer surface of the convergent nozzle and an inner surface of the burner housing.

According to another aspect of the present disclosure, a method for using a burner is provided. The method can comprise: providing at least one air pipe and at least one fuel pipe of the burner; disposing a plurality of groups of mixing units at a downstream end of the burner, wherein each of the plurality of groups of mixing units can be arranged coaxially and adjacent to one another, and each group of mixing units can comprise at least one fuel channel connected to the at least one fuel pipe and at least one air channel connected to the at least one air pipe; arranging an outlet of the at least one fuel channel and an outlet of the at least one air channel such that the outlet of the at least one fuel channel and the outlet of the at least one air channel are angled relative to one another; supplying the air to the at least one air pipe; supplying the fuel to the at least one fuel pipe; mixing, by the plurality of groups of mixing units, the fuel flowing out of the outlet of the at least one fuel channel with the air flowing out of the outlet of the at least one air channel, thereby achieving multiple-stage mixing of the air and the fuel.

According to a further aspect of the present disclosure, a burner is provided. The burner can comprise: at least one air pipe; at least one fuel pipe; a plurality of groups of mixing units disposed at a downstream end of the burner, wherein each of the plurality of groups of mixing units can be arranged coaxially and adjacent to one another, and each group of mixing units can comprise at least one fuel channel connected to the at least one fuel pipe and at least one air channel connected to the at least one air pipe, wherein an outlet of the at least one fuel channel and an outlet of the at least one air channel can be angled at a certain degree relative to one another such that the fuel flowing out of the outlet of the at least one fuel channel is mixed with the air flowing out of the outlet of the at least one air channel, and wherein an air velocity of the air flowing out of the at least one air channel can be configured to be greater than a fuel velocity of the fuel flowing out of the at least one fuel channel such that at least one negative pressure is formed at a mixing location of the air and fuel.

According to an additional aspect of the present disclosure, a burner for generating a controlled flame is provided. The burner can comprise a burner housing arranged to encompass a burner body of the burner; a convergent nozzle arranged at an outlet of the burner; a central flame forming mechanism and a peripheral flame forming mechanism arranged along the downstream of the burner body adjacent to the convergence nozzle, wherein the central flame forming mechanism can comprise a plurality of central air channels and a plurality of central fuel channels, which can be angled with respect to an axial direction of the burner body, and wherein the peripheral flame forming mechanism can comprise a plurality of peripheral air channels and a plurality of peripheral fuel channels, which can be angled with the axial direction of the burner body, and whereby, a mixture of fuel and air can be ejected from the convergent nozzle through the central flame forming mechanism and peripheral flame forming mechanism, forming the controlled flame having an inner flame and a peripheral flame, wherein the inner flame is surrounded by a peripheral flame to form a desired shape of the controlled flame.

Other objects and features of the present invention will become apparent by a review of the specification, claims, and appended figures.

Incorporation by Reference

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

The apparatus, systems and methods as described herein relate to burners that are capable of providing uniform mixtures of air and fuel, with low oxides of nitrogen (NOx) emissions and improvements in thermal efficiency. To this end, a firing plate with potential variations in some embodiments is designed and placed at a downstream of the burner in a direction of fuel flow. With aid of the firing plate, the air and fuel discharged or injected from an air channel and a fuel channel respectively, can be sufficiently mixed with one another to form a uniform mixture. Since the firing plate has a multi-stage shaped cross section and mixing of the air and fuel can occur at each stage, a multi-stage mixing of the air and fuel can be achieved without requiring additional mechanical mechanisms or components which could add to manufacturing costs and complexity. By properly controlling an air velocity and a fuel velocity, a negative pressure can be generated when the air velocity is greater than the fuel velocity, resulting in an increased fuel velocity. Therefore, more fuel will be drawn into the mixing, leading to more uniform mixing and higher fuel-to-air ratio. The technical effects and advantages as discussed herein are only for illustrative purposes and other effects or advantages may also be understood based on the embodiments of the present disclosure, as will be discussed in detail later.

It shall be understood that different aspects of the present disclosure can be appreciated individually, collectively, or in combination with each other. Various aspects of the disclosure described herein may be applied to any of the particular applications set forth below or for any other types of furnaces or burners.

The detailed descriptions of embodiments of the present disclosure will be set forth hereinafter with reference to the accompanying drawings.

Figure 1:
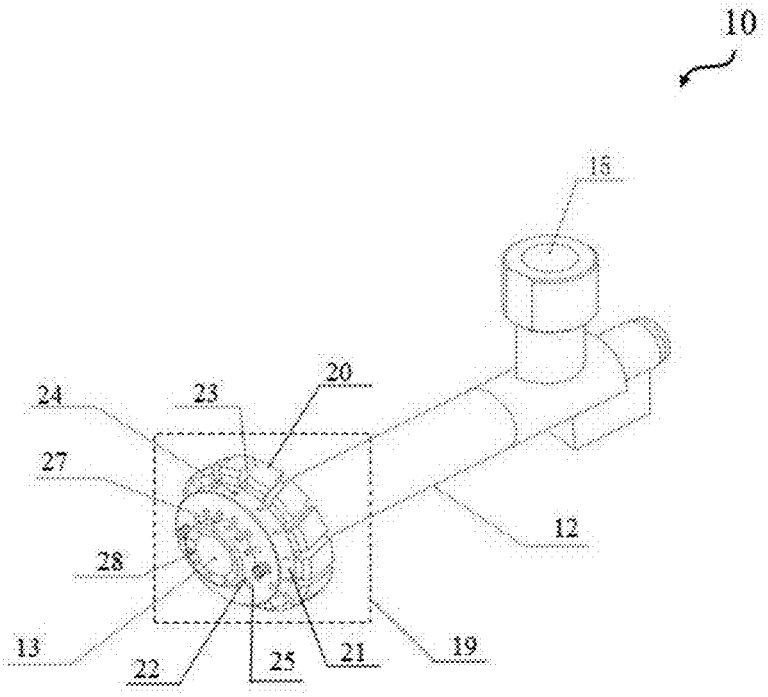
FIG. 1 illustrates a perspective view of a burner, in accordance with some embodiments of the present disclosure.

FIG. 1 illustrates a perspective view of a burner 10 in accordance with some embodiments of the present disclosure. For purposes of illustration and in the interest of clarity, the burner in FIG. 1 is shown with its outer housing or casing removed. The burner as described herein can be used for a wide variety of applications, such as petroleum cracking, metal raw material melting, raw material sintering and heat treatment, or the like. As an example, the burner described herein may be used in industrial furnaces and can provide advantages such as energy conservation and low nitrogen release.

As shown FIG. 1, the burner 10 comprises a burner body 12 which may be cylindrical in shape, although other geometrical shapes may also be applied. At least one air pipe (or passage) 13 is located inside the burner body and provided along a central longitudinal axis of the burner body. The air pipe is configured to receive air from the surrounding environment, and permits the air to flow through. Provided between an outer surface 13-1 of the air pipe 13 and an inner surface 12-1 of the burner body 12 is a hollow and annular fuel pipe (such as fuel pipe 14 shown in FIG. 2), which can permit fuel from a fuel inlet 15 to flow through. The burner 10 can be supported by a burner housing, such as burner housing 16 shown in FIG. 2. An annular air chamber (such as annular air chamber 17 shown in FIG. 2) is provided between an outer surface 14-1 of the fuel pipe 14 and an inner surface 16-1 of the burner housing 16. The annular air chamber comprises an air inlet 18 arranged on the burner housing. In some embodiments (not shown), the annular air chamber can be connected with the air pipe 13. Accordingly, in those embodiments, the air received from the air inlet 18 can flow through both the air pipe and the annular air chamber.

Arranged on a front end of the burner body is a firing plate 19, which is configured to provide uniform and multi-stage mixing of the incoming air and fuel. The firing plate may comprise a plurality of stages, for example a first stage 20 of the firing plate, a second stage 21 of the firing plate, and a third stage 22 of the firing plate. In some embodiments, the plurality of stages may be formed as three frustums of a cone, for example shown in FIG. 2. The stages may be coaxially adjacent to one another and may have progressively decreasing diameters along the downstream direction of the burner. In some embodiments, one or more air channels 23 can be arranged on a periphery of an outer edge of the first stage 20. For example, the air channels can be formed as slots or grooves evenly-spaced around the periphery of the first stage 20. The air channels may be formed between the outer surface of the first stage of the firing plate and the inner surface of the burner housing. In some embodiments, the central longitudinal axis of the air channel can be parallel to the central longitudinal axis of the burner body. In some embodiments, the central longitudinal axis of the air channel may be oblique relative to the central longitudinal axis of the burner body.

Further shown in FIG. 1 are one or more outlets of one or more fuel channels 24 radially arranged on the second stage 21 of the firing plate. The number of fuel channels 24 can be the same or different from the number of air channels 23 arranged on the first stage 20 of the firing plate. In some embodiments, the number of fuel channels 24 may or may not be proportional to the number of air channels 23. For example, the fuel channels and air channels can be in a one-to-one relationship. In some cases, the air channel arranged on the first stage of the firing plate and the fuel channel arranged on the second stage of the firing plate collectively constitutes a mixing unit. Therefore, the annularly arranged air channels and fuel channels can form a first group of mixing units for mixing the fuel and air when the fuel and air are being discharged from the respective channels. In some embodiments, a central longitudinal axis of each of a plurality of air channels on the first stage of the firing plate has an angle relative to a central longitudinal axis of the corresponding one of a plurality of fuel channels on the second stage of the firing plate. The angle between the central axes of an air channel and a corresponding fuel channel may range from approximately 45 degrees to 120 degrees. In some preferred embodiments, the angle may be approximately 90 degrees, such that the fuel flowing out of the fuel channel and the air flowing out of the air channel is perpendicular to one another, which promotes mixing of the air and fuel.

One or more air channels can be arranged on the second stage of the firing plate, having respective outlets 25 as shown in FIG. 1. In some instances, the air channels on the second stage of the firing plate can extend in a direction parallel to and annularly around the central longitudinal axis of the second stage of the firing plate, such as the air channels 26 shown in FIG. 2. Similar to the first and second stages of the firing plate, the third stage of the firing plate may comprise one or more fuel channels arranged thereon, having respective outlets 27 as shown in FIG. 1.

The number of fuel channels arranged on the third stage can be the same or different from the number of air channels arranged on the second stage 21 of the firing plate. In some embodiments, the number of fuel channels arranged on the third stage may or may not be proportional to the number of air channels arranged on the second stage. For example, the fuel and air channels can be in a one-to-one relationship or in a one-to-many relationship. In some cases, the air channels arranged on the second stage of the firing plate and the fuel channels arranged on the third stage of the firing plate collectively constitutes a mixing unit. Accordingly, the annularly arranged air and fuel channels can form a second group of mixing units for mixing the fuel and air as the fuel and air are being discharged from the respective channels.

In some embodiments, a central longitudinal axis of each of a plurality of air channels on the second stage of the firing plate has an angle relative to a central longitudinal axis of the corresponding one of a plurality of fuel channels on the third stage of the firing plate. The angle may range from approximately 45 degrees to 120 degrees. In some preferred embodiments, the angle may be at approximately 90 degrees, such that the fuel flowing out of the fuel channel and the air flowing out of the air channel is perpendicular to one another, which promotes mixing of the air and fuel. Further shown in FIG. 1 is the third stage 22 of the firing plate with the air pipe 13 at the center and one or more fuel channels annularly surrounding the air pipe. The central longitudinal axes of outlets 28 of the fuel channels have an angle with respect to the central longitudinal axis of the air pipe, for example in a range from about 30 degrees to about 90 degrees.

In some embodiments, a plurality of fuel channels 28 can be evenly spaced around the air pipe 13. In some cases, the fuel channels arranged on the third stage of the firing plate and the air pipe which also serves as an air channel at the third stage, collectively constitutes a third group of mixing units for mixing the fuel and air as the fuel and air are being discharged from the respective channels.

From the foregoing description with reference to FIG. 1, it can be understood that the embodiments of the present disclosure can be used to implement multiple-stage mixing of the fuel and air via the firing plate with multiple stages. Through stage-by-stage mixture, the air and fuel can be sufficiently premixed at the respective outlets of the air channels and fuel channels and can be further mixed within a main mixing chamber 29 (see FIG. 2) located in front of the outlet of the air pipe. Accordingly, a fuel mixture having a desired concentration and mixture ratio can be generated, which prevents the flashback or blowout due to excessive mixing observed in conventional burners.

It can be understood that the shapes and arrangements of the firing plate as described herein are only for illustrative purposes and any suitable changes can be made without departing from the scope and spirit of the present disclosure. For example, although the firing plate and each stage thereof are shown as circular, the cross sections of the firing plate and each stage can be designed and manufactured having other shapes, such as oval, rectangular, triangular, trapezoid, pentagon, or any other regular or irregular polygons. Further, although the firing plate according to the embodiments of the present disclosure is depicted herein as a frustum of a cone with three stages (or three different frustums of a cone), other polyhedrons, such as a cuboid, cube, or the like, should also be envisaged by those skilled in the art based upon the teaching of the present disclosure.

In addition, although the air and fuel are introduced into the mixing chamber through a plurality of air and fuel channels (in the forms of apertures or openings) arranged in a series of axially adjacent stages, they can also be introduced into the mixing chamber via axially spaced stages. In some embodiments, the air and fuel channels are canted or canted relative to one another to develop a swirling of gas mixture, thereby enhancing fuel-air intermixture, ignition control and flame retention. According to the embodiments of the present disclosure, various parameters of the air channels and fuel channels can be determined depending on manufacturing requirements. The parameters may include but are not limited to a size (including diameter, radius, length, height, and width), a shape, a location, an orientation, a relative distance with respect to one or more axes or planes, for one or more components of the disclosed burner.

It is to be understood that the term "air" in the present disclosure may include any suitable oxidant that can cause or contribute to the combustion of other material, such as the ambient air or supplied oxygen, which allows for ignition and combustion. Further, the term "fuel" in the present disclosure may include any fuel gas, such as acetylene, natural gas, or propane, which, upon being mixed with the oxidant, produces a controlled flame used for petroleum cracking, metal raw material melting, raw material sintering and heat treatment.

It is further understood that FIG. 1 only illustrates some main components of the burner in accordance with the embodiments of the present disclosure, other components or optional components, can also be added in the burner as discussed herein as necessary. For example, one or more controllers or controlling mechanisms can be introduced to control the pressure, volume or flow velocity of the air and fuel. These controllers can be external to the burner or internal to the burner, for example, arranged inside of the burner, and can be manually controlled by the user. In some embodiments, one or more sensors can be arranged within the burner and therefore the operating states of the burner can be monitored by the user and can be adjusted as needed.

Figure 2:
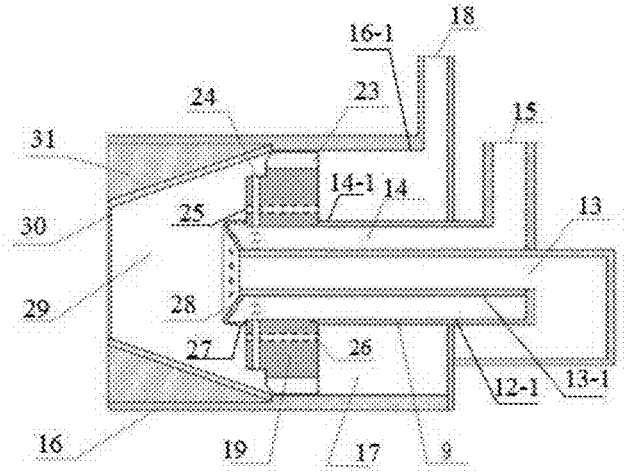
FIG. 2 illustrates a cross-sectional view of a burner, in accordance with some embodiments of the present disclosure.

FIG. 2 illustrates a cross-sectional view of a burner in accordance with some embodiments of the present disclosure. In particular, FIG. 2 illustrates additional details of an interior of the burner and an exemplary structure of a firing plate inside a burner body, similar to those exemplarily discussed with reference to FIG. 1. In some embodiments, the burner discussed with reference to FIG. 2 may have the same or similar (external or internal) structure as the one discussed with reference to FIG. 1. In some other embodiments, the burner discussed herein may be configured or manufactured to have a different structure from the one shown in FIG. 1, as envisaged by those skilled in the art based upon the teaching of the present disclosure. In the following, merely for the purpose of easy understanding and discussion, detailed description of the burner illustrated in FIG. 2 will be made together with reference to those same or similar elements, components, or assemblies as discussed in FIG. 1.

As illustrated in FIG. 2, the burner has a cylindrical shape and the air pipe 13 is arranged extending along the central longitudinal axis of the burner body towards the downstream end of the burner where the firing plate is disposed. In some embodiments, the air pipe may be arranged parallel to the central longitudinal axis of the burner body. In some other embodiments, the air pipe may be arranged oblique to the central longitudinal axis of the burner body. The air flowing through the air pipe can be provided from the air inlet 18, which may be connected with an air source or means for supplying volumes of air under pressure to the air inlet 18. For example, the air source may comprise a centrifugal fan unit having an air intake and an air discharge that is connected to the air inlet 18 for injecting the air into the air pipe. Further shown in FIG. 2 is the fuel pipe that is coaxial with the air pipe and forms a hollow passage between the inner surface of the fuel pipe 14 and the outer surface of the air pipe 13. In some embodiments, the fuel inlet 15 may be connected to a fuel source, which may be regulated to deliver one or more compressed fuels into the fuel pipe 14 via the fuel inlet 15. The annular air chamber 17 can be formed between the outer surface of the fuel pipe and the inter surface of the burning housing 16. As described elsewhere herein, the annular air chamber may be in connection with the air pipe 13 and both may in fluid communication with the same air source. In some instances, the annular air chamber may be connected to a separate air source.

The firing plate as shown is disposed on the downstream end of the air and fuel pipes. In some embodiments, the firing plate according to the embodiments of the present disclosure may be integrally formed with the air and fuel pipes or at least a section thereof. In some embodiments, the downstream end of the air and fuel pipes may be connected via threads with the firing plate. In some embodiments, the downstream end of the air and fuel pipes may be coupled (e.g., welded) to the firing plate. As discussed before with reference to FIG. 1, the firing plate can be a three-stage cylindrical structure. The air channels 23 are annularly arranged around the periphery of the first stage of the firing plate 19. In some embodiments, the air channels may be evenly spaced around the periphery of the first stage of the firing plate. In some embodiments, the air channels need not be evenly spaced around the periphery of the first stage of the firing plate. The number of air channels may be odd or even. For example, the number of air channels may be 4, 6, 8, 12, 14, 16, 18, 20, 24, 28, 30 or more. In some instances, the number of air channels may be 3, 5, 7, 9, 11, 13, 15, 17, 19, 21, 23, 25, 27, 29, 33 or more. The number of air channels can be determined based on one or more factors, such as the dimension or size of the first stage, for example, width or radius of the first stage, the desired volume of the air, air velocity or the like. In some embodiments, the radius of each stage can be 30 mm (millimeter), 40 mm, 45 mm, 50 mm, 55 mm, 60 mm, 65 mm, 70 mm, 75 mm, 80 mm, 85 mm, 90 mm, 1 m (meter), 1.1 m, 1.2 m, 1.3 m, 1.5 m, 1.6 m, 1.8 m, 1.9 m, 2.0 m, 2.2 m, 2.4 m, 2.5 m, 2.6 m, 2.7 m, 2.8 m, 2.9 m, 3.0 m, 3.2 m, 3.4 m, 3.6 m, 3.0 m, 3.5 m, 4.0 m. The radius can be more than or less than any values as exemplarily listed herein to meet the requirements of practical applications. Further, the radius can be selected from a scope ranging between any of two values as exemplarily listed herein.

The air channels 23 herein may be confined by the inner surface of the burner housing and the outer surface of the first stage of the firing plate, thereby forming one or more hollow air passages, through which the air flowing from the air pipe will be discharged into the main mixing chamber 29. The cross section of the air channels 23 can be rectangular, thereby forming one or more slots or grooves around the periphery of the first stage of the firing plate. In some embodiments, the central longitudinal axis of the slots or grooves may be parallel to one of the central longitudinal axis of the burner body and the central longitudinal axis of the air pipe. In some embodiments, the central longitudinal axis of the slots has an angle relative to the central longitudinal axis of the air pipe, for example, ranging from about 30 degrees to about 85 degrees.

The air channels 26 may be hollow air passages passing through within the first and second stages of the firing plate along respective central axes parallel to the central longitudinal axis of the burner body. With this arrangement, the air within the annular air chamber 17 can directly flow into the main mixing chamber 29 by internally passing through the first and second stages of the firing plate. The fuel channels 24 are disposed within the second stage of the firing plate with outlets near the outlets of the air channel 23. In some embodiments, the fuel channels may be arranged radially extending from the inter surface of the fuel pipe 14. As described elsewhere herein, the central longitudinal axis of the fuel channels 24 may be angled relative to the central longitudinal axis of the air channels 23. In some embodiments, the central longitudinal axis of the fuel channels 24 may have an angle relative to the central longitudinal axis of the burner body ranging from approximately 45 degrees to 120 degrees. In some instances, the angle may be at approximately 90 degrees. With aid of this angular arrangement, the fuel and air can be sufficiently mixed to obtain premixed combustible fuel, which can be considered as a first-stage mixture according to the embodiments of the present disclosure.

Further shown on the third stage of the firing plate are annular fuel outlets 27 of the fuel pipe 15 and the annular air outlets 28 of the air pipe 13. The fuel pipe and air pipe serve as a fuel channel and an air channel, respectively, with annularly-arranged outlets. It can be seen from FIG. 2 that the central longitudinal axis of the air channels 26 may have an angle relative to the central longitudinal axis of the outlets 27, for example, at approximately 90 degrees. In this way, the fuel discharged from the fuel pipe and air discharged from the annular air chamber can be tangentially mixed with each other at the outlets, resulting in an adequate premix, which constitutes a second-stage mixture.

The annular fuel outlets 28 of the air pipe 13 can be evenly spaced around the calathiform (i.e., a bowl-like shape) portion of the third stage and has an angle relative to the central longitudinal axis of the air pipe. In some embodiments, the angle between the central longitudinal axis of the fuel outlet 28 and the central longitudinal axis of the air pipe may be in a range from about 30 degrees to about 90 degrees. In this manner, the fuel flowing from the fuel pipe and air flowing from the air pipe can be mixed ahead of the outlets of the air pipe (i.e., at the main mixing zone), resulting in an adequate premix, which collectively constitutes a third-stage mixture according to the embodiments of the present disclosure.

In some embodiments, the total sectional area of the air channels on the first stage of the firing plate may account for approximately 50%~80% of the total sectional area of all the air channels on the three stages of the firing plate. In some embodiments, the total sectional area of the air channels on the first stage of the firing plate may account for approximately 60% of the total sectional area of all the air channels on the three stages of the firing plate. The fuel pressure or air pressure in accordance with the embodiments of the present disclosure may be at 1 kg/cm$^2$, 1.5 kg/cm$^2$, 1.6 kg/cm$^2$, 1.8 kg/cm$^2$, 2.0 kg/cm$^2$, 2.2 kg/cm$^2$, 2.4 kg/cm$^2$, 2.5 kg/cm$^2$, 2.7 kg/cm$^2$, 2.8 kg/cm$^2$, 3.0 kg/cm$^2$, 3.2 kg/cm$^2$, 3.5 kg/cm$^2$, 3.8 kg/cm$^2$, 4.0 kg/cm$^2$, 4.1 kg/cm$^2$, 4.2 kg/cm$^2$, 4.4 kg/cm$^2$, 4.5 kg/cm$^2$, 4.6 kg/cm$^2$, 4.7 kg/cm$^2$, 4.8 kg/cm$^2$, 4.9 kg/cm$^2$ or 5.0 kg/cm$^2$. Alternatively or additionally, the fuel pressure or air pressure may be at 500 Pa, 600 Pa, 650 Pa, 700 Pa, 750 Pa, 800 Pa, 850 Pa, 900 Pa, 1000 Pa, 1100 Pa, 1200 Pa, 1300 Pa, 1500 Pa, 1600 Pa, 1700 Pa, 1800 Pa, 2000 Pa, 2200 Pa, 2300 Pa, 2500 Pa, 2700 Pa, 2800 Pa, 3000 Pa, 3100 Pa, 3200 Pa, 3500 Pa, 3600 Pa, 3800 Pa, 4000 Pa, 4200 Pa, 4300 Pa, 4400 Pa, or 4500 Pa. The fuel or air pressure herein may be more than or less than any value as exemplarily listed herein. Further, the fuel or air pressure can be selected from a scope ranging between any of two values as exemplarily listed herein.

A convergent nozzle 30 may be formed inside the burner housing and ahead of the firing plate, thereby defining the mixing chamber 29. The convergent nozzle can be made of fire-resistant and nonmetal materials. In some instances, refractory materials 31 can be filled between the outer surface of the convergent nozzle and the inner surface of the burner housing. Thereby, the burner housing can be protected from being damaged or deformed by burned air-fuel mixture, i.e., combustible fuel. In some embodiments, in order to obtain a desired flame shape, the convergent nozzle 30 can be arranged to converge at a predetermined angle relative to the central longitudinal axis of the burner body. For example, the convergent nozzle 30 may converge at an angle of about 20 degrees to about 70 degrees relative to the central longitudinal axis of the burner body. In some embodiments, the convergence angle herein may be about 45 degrees.

In operation, an operator can use an ignition apparatus to ignite the burner. The ignition apparatus may comprise a small burner capable of receiving fuel from the fuel source and air from the air source to form a combustible mixture, which can be subsequently ignited by an ignition device. In some embodiments, the ignition device may be a spark plug or similar device. The ignition of the burner according to the embodiments of the present disclosure can occur at any location where the air flowing from the outlet of the air channel and the fuel flowing from the outlet of the fuel channel are mixed with one another. Therefore, it would be easy for the operator to select and configure an ignition position of the burner. The ignition of the burner may take place in a few seconds after the multiple-stage mixing of the air and fuel. Depending on the multiple-stage arrangement together with outer and inner annular designs of the air channels and fuel channels, the burner according to the embodiments of the present disclosure can be used to generate a controlled flame for many different applications. Different portions of the flame burned after agitation of the combustible gas inside the main mixing chamber can have different temperatures. In some cases, a center temperature of the flame may be in a range from 1000° C.~1800° C., 1200° C.~2000° C., or 1500° C.~2200° C. The center temperature of the flame can be in a range defined by any values as exemplarily listed herein. In some embodiments, the center temperature of the flame may be approximately at 1400° C. Further, an edge temperature of the flame may be in a range from 800° C.~1100° C., 900° C.~1200° C., or 950° C.~1300° C. The edge temperature of the flame may be in a range defined by any values as listed herein. In some embodiments, the edge temperature of the flame may be at 850° C.

Figure 3:
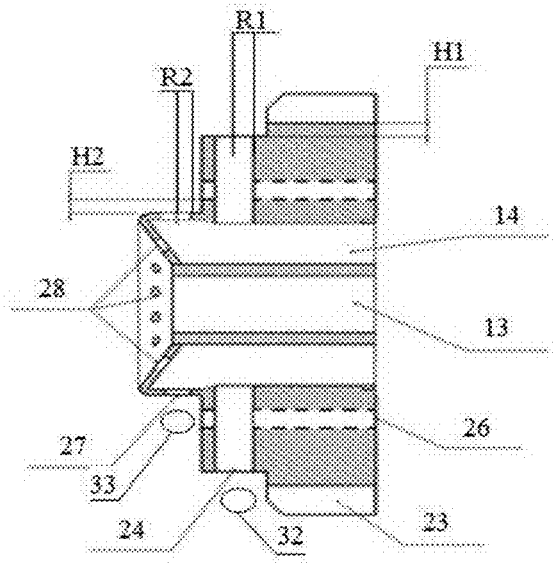
FIG. 3 illustrates a cross-sectional view of a firing plate of the burner shown in FIG. 2, in accordance with some embodiments of the present disclosure.

FIG. 3 illustrates a cross-sectional view of a firing plate of the burner as shown in FIG. 2, in accordance with some embodiments of the present disclosure. In the interest of clarity, FIG. 3 only illustrates the firing plate as show in FIG. 2, with the burner housing 16 and convergent nozzle 30 omitted.

As illustrated in FIG. 3, the fuel can be passed through the fuel pipe 14 and enter into the mixing zones via outlets of the fuel channels arranged on each stage of the firing plate. Likewise, the air can also be passed through the air pipe 13 and enter into the mixing zones via outlets of the air channels arrange on each stage of the firing plate. The mixing zones, where the air and fuel are mixed, are positioned in proximity to the air outlet and corresponding fuel outlet, such as the zones shown at 32 around the second stage of the firing plate and at 33 around the third stage of the firing plate, or zones in front of the central air pipe. In this manner, the multi-stage mixture of the air and fuel can be achieved via the firing plate according to the embodiments of the present disclosure.

In some embodiments, when the cross section of the fuel channels 24 is circular, the radius R1 of the fuel channel can be set taking into account a vertical distance H1 of the bottom surface of the air channel 23 to the outer edge of the second stage of the firing plate. In some instances, the radius R1 can be set as R1≤H1≤2R1. In some embodiments, the size of R1 can be set equal to the size of H1. Similarly, when the cross section of the fuel outlet 27 on the third stage of the firing plate is circular, the radius R2 thereof can be set taking into account a vertical distance H2 of the bottom surface of the air channel 26 to the outer edge of the second stage of the firing plate. In some instances, the radius R2 can be set as R2≤H2≤2R2. In some embodiments, the size of R2 can be set equal to the size of H2.

Figure 4A:
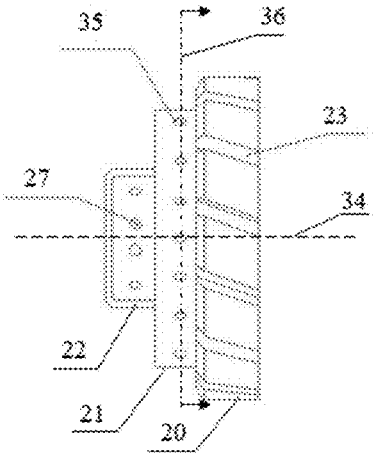
FIG. 4A illustrates a lateral view of the firing plate shown in FIG. 3, in accordance with some embodiments of the present disclosure.

FIG. 4A illustrates a lateral view of the firing plate as shown in FIG. 3, in accordance with some embodiments of the present disclosure. It can be seen from FIG. 4A that the firing plate in accordance with the embodiments of the present disclosure comprises multiple stages, such as the first stage 20, second stage 21 and third stage 22, which are exemplarily shown as adjacent to one another in series along the central longitudinal axis 34 of the burner body.

As shown in FIG. 4A, the air channels 23 are annularly arranged around the periphery of the first stage 20 of the firing plate. The central axes of the air channels can be angled or oblique with respect to the central longitudinal axis of the firing plate, such as those depicted in FIG. 4A. Alternatively or additionally, the central axes of the air channels 23 can be arranged to be parallel to the central longitudinal axis of the burner body. Although shown as evenly spaced around the periphery of the first stage, the air channels 23 can also be unevenly spaced annularly around the periphery of the first stage.

Further shown at the second stage 21 of the firing plate are fuel outlets 35 of the fuel channels 24. It can be seen from the illustration that the fuel outlets are holes or openings circumferentially arranged around the periphery of the second stage 21, through which the fuel is discharged into the mixing zone for the first-stage mixture according to the embodiments of the present disclosure. As previously discussed, the central axes of the fuel outlets 35 have an angle with respect to the central axes of the air channels 23. In some embodiments, the central axes of the fuel outlets 35 can be perpendicular to the central axes of the air channels, thereby further facilitating mixing of the air and fuel at the mixing zones. Although the fuel outlets 35 as illustrated are evenly spaced around the periphery of the second stage of the firing plate, the fuel outlets 35 may be unevenly spaced around the periphery of the second stage of the firing plate. In some instances, one fuel outlet 35 may correspond to one air channel 23. Alternatively, one fuel outlet 35 may correspond to two or more air channel 23. In some instances, one air channel 23 may correspond to two or more fuel outlet 35.

Further illustrated in FIG. 4A are fuel outlets 27 annularly arranged around the periphery of the third stage 22 of the firing plate. The fuel outlets are formed as holes or grooves surrounding the third stage. In operation, the fuel flowing out of the fuel outlets 27 can be mixed with the air flowing out of the air outlets 25, thereby forming a second-stage mixing according to the embodiments of the present disclosure. As previously noted, the central longitudinal axis of the fuel outlet 27 has an angle with respect to the central longitudinal axis of the corresponding air outlet 25. In some embodiments, the angle can be 90 degrees. Additionally, the number of fuel outlets 27 can be the same as the number of air outlets 25. Alternatively, the number of fuel outlets 27 can be more than or less than the number of air outlets 25. In some embodiments, the number of fuel outlets 27 can be proportional to the number of air outlets 25.

Figure 4B:
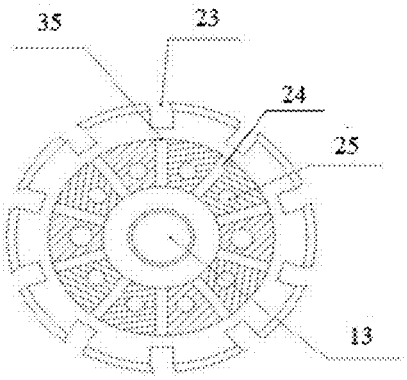
FIG. 4B illustrates a partial cross-sectional view of the firing plate shown in FIG. 3, in accordance with some embodiments of the present disclosure.

FIG. 4B illustrates a cross sectional view of the firing plate, taken from a cross-section line 36 in FIG. 4A, in accordance with some embodiments of the present disclosure. As illustrated in FIG. 4B, the first, second and third stages of the firing plate are coaxial with one another. The air channels 23 are circumferentially arranged around the first stage of the firing plate. The fuel channels 24 radially extend from the center of the firing plate and are evenly spaced between the air outlets 25 of the air channels 26 circularly arranged about the center of the firing plate. At the center of the firing plate is the air pipe 13 which serves as a passage for supplying air to the air channels on each stage of the firing plate.

From the foregoing description made with reference to FIGS. 1-4, a person skilled in the art can understand that the embodiments of the present disclosure also disclose a burner for generating a controlled flame. The burner may comprise a burner housing arranged to encompass a burner body of the burner, such as the burner housing 16 and the burner body 12 as discussed above. The burner may further comprise a convergent nozzle arranged at an outlet of the burner, where the mixture of the air and fuel can be accelerated to be ejected from the outlet of the burner while burning. In some embodiments, the burner can have a central flame forming mechanism comprising a plurality of central air channels and a plurality of central fuel channels. The central flame forming mechanism can be the third stage 22 of the firing plate, for example, as previously described with respect to FIG. 2, wherein the plurality of central air channels can be the air pipe along the central longitudinal axis of the burner body and the plurality of central fuel channels can be fuel channels or fuel outlets 27. As discussed before, the central longitudinal axes of the air channels and fuel channels can be angled with respect to one another. In some instances, the central longitudinal axes of the air channels and fuel channels can be angled with respect to the central longitudinal axis of the burner body.

In some embodiments, the burner as discussed above may further comprise a peripheral flame forming mechanism comprising a plurality of peripheral air channels and a plurality of peripheral fuel channels. The peripheral flame forming mechanism may comprise the first and second stages of the firing plate, wherein the air channels on the first and second stages of the firing plate correspond to peripheral air channels, and the fuel channels on the first and second stages of the firing plate correspond to peripheral fuel channels. The central longitudinal axis of the air channel and the central longitudinal axis of the fuel channel can be angled with respect to each other, to promote premixing of the air and fuel.

The central flame forming mechanism and the peripheral flame forming mechanism described herein can be arranged along the downstream end of the burner body adjacent to the convergence nozzle. In this manner, a mixture of fuel and air can be ejected out of the convergent nozzle after passing through the central flame forming mechanism and peripheral flame forming mechanism, thereby forming the controlled flame having an inner flame and a peripheral flame, wherein the inner flame is surrounded by the peripheral flame to form a desired shape of the controlled flame. In practice, the flame can be stretched by a distance (e.g. one or two meters) from the outlet of the burner in an axial direction of the burner. In view of this, the target objects can be pre-located one or two meters away from the outlet of the burner, thereby achieving a good heating effect.

Figure 5:
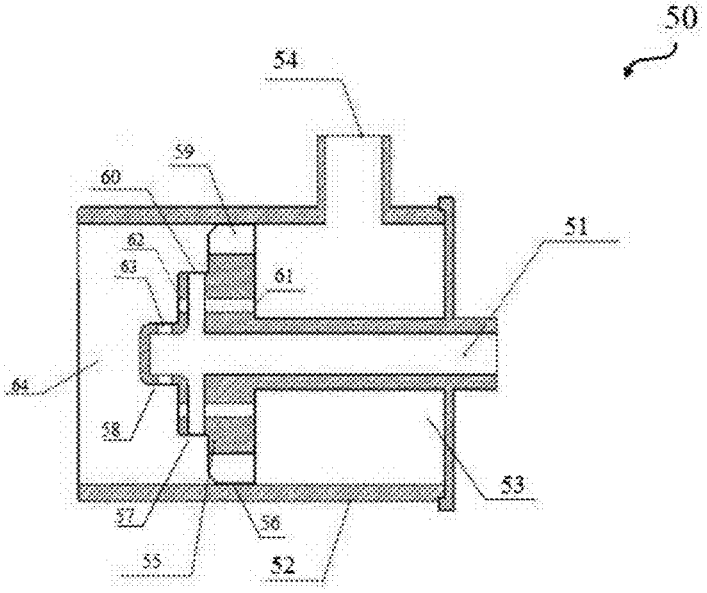
FIG. 5 illustrates a cross-sectional view of a burner, in accordance with some other embodiments of the present disclosure.

FIG. 5 illustrates a cross-sectional view of a burner 50, in accordance with some embodiments of the present disclosure. The functionality of the burner 50 is similar to the burner 10 as discussed with reference to FIGS. 1-4. For example, the burner 50 can be used for many applications, such as petroleum cracking, metal raw material melting, raw material sintering and heat treatment, or the like.

As shown FIG. 5, the burner 50 has a burner body which can be cylindrical shape as a whole, wherein at least one fuel pipe (or passage) 51 is located therein and disposed along a central longitudinal axis of the cylinder. The burner 50 can be supported by a burner housing, such as a burner housing 52, and an annular air chamber 53 can be formed between an outer surface of the fuel pipe and an inner surface of the burner housing with an air inlet 54 arranged on the burner housing. In some embodiments, the annular air chamber can communicate with an air pipe via the air inlet 54. Accordingly, the air injected from the air inlet 54 can flow along both the air pipe and annular air chamber.

Arranged on a downstream end of fuel pipe 51 is a firing plate 55, which is capable of uniform and multi-stage mixing of the air and fuel. As shown, the firing plate may comprise three frustums of a cone corresponding to a first stage 56 of the firing plate, a second stage 57 of the firing plate, and a third stage 58 of the firing plate, which are coaxially adjacent to one another and have progressively decreasing diameters along the downstream of the burner. In some embodiments, one or more air channels 59 can be arranged on a periphery of an outer edge of the first stage 56. For example, the one or more air channels can be formed from slots or grooves, which can be evenly-spaced around the periphery of the first stage 56, thereby forming air channels between the outer surface of the first stage of the firing plate and the inner surface of the burner housing. In some embodiments, the central longitudinal axis of the air channel can be parallel to the central longitudinal axis of the burner body. In some embodiments, the central longitudinal axis of the air channel may be oblique relative to the central longitudinal axis of the burner body.

FIG. 5 further shows one or more outlets of one or more fuel channel 60 radially arranged on the second stage 57 of the firing plate. The number of fuel channels 60 may be the same or different from the number of air channels 59 arranged on the first stage 56 of the firing plate. In some embodiments, the number of fuel channels 60 may or may not be proportional to the number of air channels 60. For example, the fuel channels and air channels can be in a one-to-one relationship. In some cases, the air channel arranged on the first stage of the firing plate and the fuel channel arranged on the second stage of the firing plate collectively constitutes a mixing unit. Therefore, the annularly arranged air channels and fuel channels can form a first group of mixing units for mixing the fuel and air as the fuel and air are being discharged from the respective channels.

In some embodiments, a central longitudinal axis of each of a plurality of air channels on the first stage of the firing plate has an angle relative to a central longitudinal axis of the corresponding one of a plurality of fuel channels on the second stage of the firing plate. The angle may range from approximately 45 degrees to 120 degrees. In some instances, the angle may be approximately 90 degrees. In this way, the fuel flowing out of the fuel channel and the air flowing out of the air channel may be perpendicular to one another, thereby facilitating the sufficient mixing of the air and fuel.

The second stage of the firing plate can also be arranged one or more air channels 61 thereon, whose respective outlets are shown at 62. In some instances, a portion of the one or more air channels 61 can also be formed within the first stage of the firing plate. The air in the annular air chamber 53 can move along the air channels into the second stage and flow out of the outlets 63. Similar to the first and second stages of the firing plate, one or more fuel channels may be arranged on the third stage of the firing plate, having respective outlets shown at 63 in FIG. 5. In some embodiments, the one or more fuel channels can be hollow passages having a predetermined length. In some instances, the one or more fuel channels can be simplified as one or more holes or openings annularly arranged around the periphery of the third stage of the firing plate, when the fuel pipe is playing a role as fuel channels for the third stage, which is depicted in FIG. 5.

In some embodiments, the number of fuel channels arranged on the third stage 58 can be the same or different from the number of air channels arranged on the second stage 57 of the firing plate. In some embodiments, the number of fuel channels arranged on the third stage may or may not be proportional to the number of air channels arranged on the second stage. For example, the fuel and air channels can be in a one-to-one relationship or in a one-to-many relationship. In some cases, the air channels arranged on the second stage 58 of the firing plate and the fuel channels arranged on the third stage 57 of the firing plate can collectively constitute a mixing unit. Therefore, the annularly arranged air and fuel channels can form a second group of mixing units for mixing the fuel and air as the fuel and air are discharged from the respective channels.

In some embodiments, a central longitudinal axis of each of a plurality of air channels on the second stage of the firing plate has an angle relative to a central longitudinal axis of the corresponding one of a plurality of fuel channels on the third stage of the firing plate, for example ranging from approximately 45 degrees to 120 degrees. In some instances, the angle may be approximately 90 degrees. In this way, the fuel flowing out of the fuel channel and the air flowing out of the air channel may be perpendicular to one another, thereby facilitating the sufficient mixing of the air and fuel.

From the foregoing description made above with reference to FIG. 5, it can be understood that the embodiments of the present disclosure implement multiple-stage mixing of the fuel and air via the firing plate with multiple stages, such as the three stages described herein. Through stage-by-stage mixing, the air and fuel can be adequately premixed at the respective outlets of the air channels and fuel channels and can be further mixed at a main mixing chamber 64 located in front of the outlet of the air pipe. In this manner, the resulting combustible fuel mixture can have a proper concentration and mixture ratio, thereby avoiding the flashback or blowout due to excessive mixing observed in conventional burners.

From the illustration in FIG. 5, it can be clear that the firing plate shown herein is similar to the one shown in FIGS. 1-4 except that the firing plate in FIG. 5 does not provide the third-stage mixing but two-stage mixing. This is because there are no further air channels and fuel channels arranged on the third stage for a third-stage mixing. In another words, the multiple-stage mixing of the present disclosure can be simplified from three-stage mixing as shown in FIGS. 1-4 to two-stage mixing as shown in FIG. 5. Therefore, it can be envisaged by those skilled in the art that the number of stages of the firing plate can be easily selected and set according to various application requirements. For example, to reduce the cost of the firing plate, a two-stage firing plate can be applied. In contrast, when the cost of the firing plate is not a concern, a three-stage firing plate or even a firing plate with more than three stages can be applied. Further, to obtain a more sufficient premix of the fuel and air, more than two or three stages of the firing plate may be applied.

Further, it is to be understood that the shapes and arrangements of the firing plate as disclosed herein are only for illustrative purposes and any suitable changes and amendments can be made without departing from the scope and spirit of the present disclosure. For example, the cross sections of the firing plate and each stage can be designed and manufactured as having various shapes, such as oval, rectangular, triangular, trapezoid, pentagon, or any other regular or irregular polygons. Further, although the firing plate according to the embodiments of the present disclosure is depicted herein as a frustum of a cone with three stages (or three different frustums of a cone), other polyhedrons, such as a cuboid, cube, or the like, should also be envisaged by those skilled in the art based upon the teaching of the present disclosure.

In addition, although the air and fuel are introduced into the mixing chamber through a plurality of air and fuel channels (specifically in forms of apertures or openings) arranged in a series of axially adjacent stages, they can also be introduced into the mixing chamber via axially spaced stages. In some embodiments, the air and fuel channels are canted or canted relative to one another to develop a swirling of gas mixture, thereby enhancing fuel-air intermixture, ignition control and flame retention. In some cases, during the course of manufacture of the burner, various parameters of the air channels and fuel channels, including but not limited to a size (including diameter, radius, length, height, and width), a shape, a location, an orientation, a relative distance with respect to one or more axes or planes, can be taken into account. Therefore, a customized burner that is more suitable for practical use can be obtained.

Further, although not shown in FIG. 5, it can be understood that a convergent nozzle can be arranged at the head of the firing plate 55 along the downstream and inside the burner housing. In this way, the main mixing chamber 64 can be formed and the mixed combustible gas at each stage of the firing plate can be further mixed in the mixing chamber, thereby, upon ignition of the combustible gas, a controlled flame can be generated and injected out of the nozzle for e.g., heating treatment.

Figure 6:
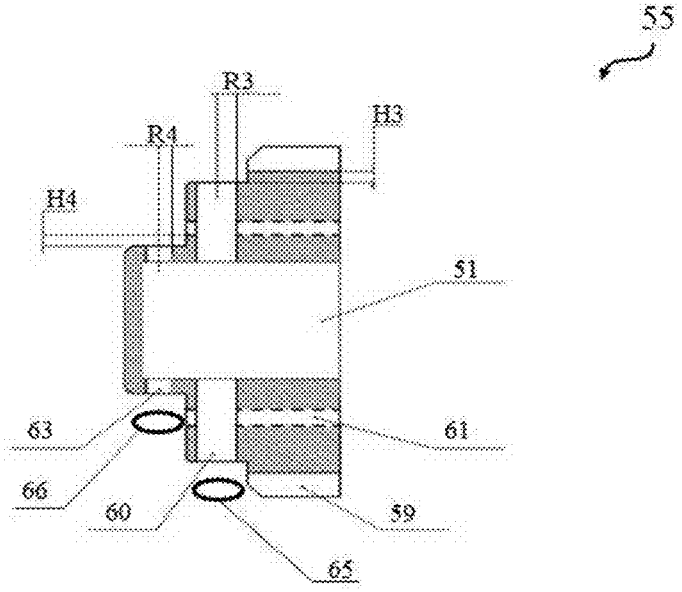
FIG. 6 illustrates a cross-sectional view of a firing plate of the burner shown in FIG. 5, in accordance with some embodiments of the present disclosure.

FIG. 6 illustrates a cross-sectional view of a firing plate of the burner shown in FIG. 5, in accordance with some embodiments of the present disclosure. In the interest of clarity, FIG. 6 only illustrates the firing plate as show in FIG. 5 with the burner housing 53 omitted.

As illustrated in FIG. 6, the fuel can be passed through the fuel pipe 51 and enter into the mixing zones via outlets of the fuel channels arranged on each stage of the firing plate. Likewise, the air can also be passed through the air pipe and enter into the mixing zones via outlets of the air channels arranged on each stage of the firing plate. The mixing zones, where the air and fuel are mixed, are positioned in proximity to the air outlet and matched fuel outlet, such as those zones shown at 65 around the second stage of the firing plate and at 66 around the third stage of the firing plate. In this manner, the two-stage mixing of the air and fuel can be achieved via the firing plate according to the embodiments of the present disclosure.

In some embodiments, when the cross section of the fuel channels 60 is circular, the radius R3 of the fuel channel can be set taking into account a vertical distance 113 of the bottom surface of the air channel 59 to the outer edge of the second stage of the firing plate. In some instances, the radius R3 can be set as R3≤H3≤2R3. In some embodiments, the size of R3 can be selected as equal to the size of the 113. Similarly, when the cross section of the fuel outlet 63 on the third stage of the firing plate is circular, the radius R4 thereof can be set taking into account a vertical distance 114 of the bottom surface of the air channel 61 to the edge of the second stage of the firing plate. In some instances, the radius R4 can be set as R4≤H4≤2R4. In some embodiments, the size of R4 can be selected as equal to the size of 114.

Figure 7A:
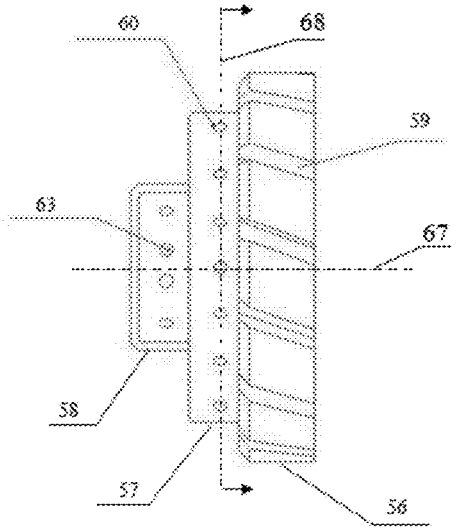
FIG. 7A illustrates a lateral view of the firing plate shown in FIG. 6, in accordance with some embodiments of the present disclosure.

FIG. 7A illustrates a lateral view of the firing plate as shown in FIG. 5, in accordance with some embodiments of the present disclosure. It can be seen from FIG. 7A that the firing plate in accordance with the embodiments of the present disclosure can comprise multiple stages, such as the first stage 56, second stage 57 and third stage 58, which are exemplarily shown as adjacent to one another in series along the central longitudinal axis 67 of the burner body.

As shown in FIG. 7A, the air channels 59 are annularly arranged around the periphery of the first stage 56 of the firing plate. The central axes of the air channels can be angled or oblique with respect to the central longitudinal axis of the firing plate, such as those depicted in FIG. 7A. Alternatively or additionally, the central axes of the air channels 59 can be arranged to be parallel to the central longitudinal axis of the burner body. Although shown as evenly spaced around the periphery of the first stage, the air channels 59 can also be annularly unevenly spaced around the periphery of the first stage.

Further shown at the second stage 57 of the firing plate are fuel outlets 60 of the fuel channels. It can be seen from the illustration that the fuel outlets are holes or openings circumferentially arranged around the periphery of the second stage 57, through which the fuel is discharged into the mixing zone for the first-stage mixture according to the embodiments of the present disclosure. As previously discussed, the central axes of the fuel outlets 60 can have a predetermined angle with respect to the central axes of the air channels 59. In some embodiments, the central axes of the fuel outlets 60 can be perpendicular to the central axes of the air channels, thereby further facilitating mixing of the air and fuel at the mixing zones. Although the fuel outlets 60 as illustrated are evenly spaced around the periphery of the second stage of the firing plate, they may be unevenly spaced around the periphery of the second stage of the firing plate. In some instances, one fuel outlet 60 may correspond to one air channel 59. Alternatively, one fuel outlet 60 may correspond to two or more air channel 59. In some instances, one air channel 59 may correspond to two or more fuel outlet 60.

Further illustrated in FIG. 7A are fuel outlets 63 annularly arranged around the periphery of the third stage 58 of the firing plate. The fuel outlets can be formed as holes or grooves surrounding the third stage. In operation, the fuel flowing out of the fuel outlets 63 can be mixed with the air flowing out of the air outlets 62, thereby forming a second-stage mixing according to the embodiments of the present disclosure. As previously noted, the central longitudinal axis of the fuel outlet 63 can have a predetermined angle with respect to the central longitudinal axis of the corresponding air outlet 62. In some embodiments, the angle can be about 90 degrees. Additionally, the number of fuel outlets 63 can be the same as the number of air outlets 62. Alternatively, the number of fuel outlets 63 can be more than or less than the number of air outlets 62. In some embodiments, the number of fuel outlets 63 can be proportional to the number of air outlets 62.

Figure 7B:
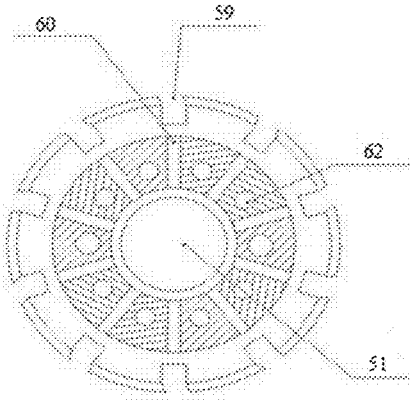
FIG. 7B illustrates a partial cross sectional view of the firing plate shown in FIG. 6, in accordance with some embodiments of the present disclosure.

FIG. 7B illustrates a partial cross sectional view of the firing plate, taken from a cross-sectional line 68 in FIG. 7A, in accordance with some embodiments of the present disclosure. As illustrated in FIG. 7B, the first, second and third stages of the firing plate are coaxial with one another. The air channels 59 are circumferentially arranged around the first stage of the firing plate. The fuel channels 60 radially extend from the center of the firing plate and are evenly spaced between the air channels circularly arranged about the center of the firing plate. At the center of the firing plate is the air pipe 51 which can serve as a passage for supplying the air to the air channels on each stage of the firing plate.

Figure 8:
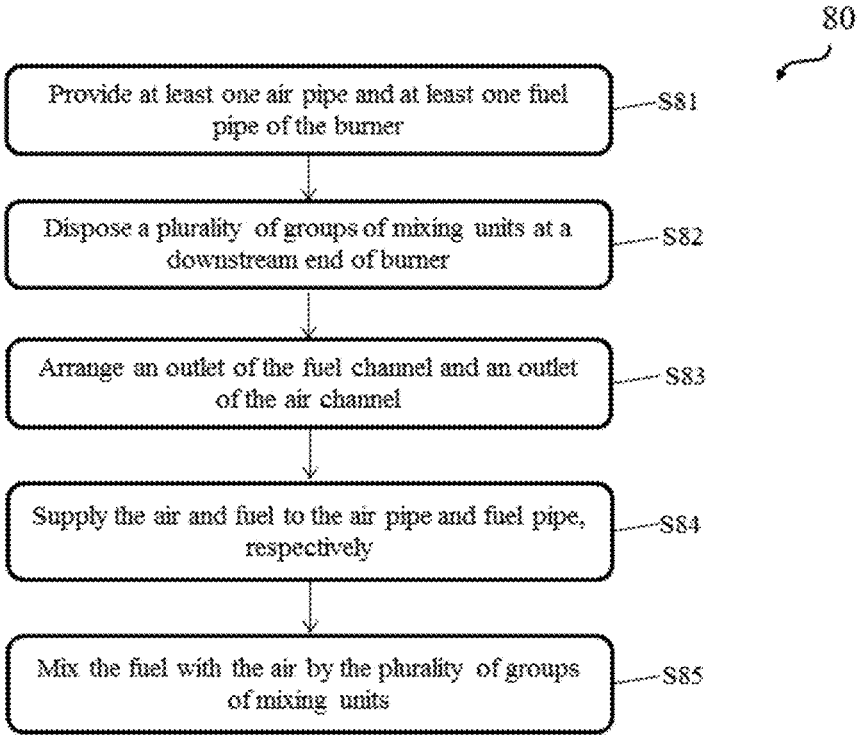
FIG. 8 illustrates a flow chart of a method for using a burner, in accordance with some embodiments of the present disclosure.

FIG. 8 illustrates a flow chart of a method 80 for using a burner, in accordance with some embodiments of the present disclosure. It is to be understood that the burner herein can be any of burners discussed previously with respect to FIGS. 1-7 or elsewhere in the specification. For example, the burner discussed in FIG. 8 can be the burner 10 as discussed with reference to FIG. 1 or the burner 50 as discussed with reference to FIG. 5. Therefore, any descriptions of the burner made before or elsewhere in the specification may also be applicable the burner discussed herein with reference to FIG. 8.

As illustrated in FIG. 8, at block S81, at least one air pipe and at least one fuel pipe of the burner are provided. The air pipe can be configured to supply the air to at least one air channel. Likewise, the fuel pipe can be configured to supply the fuel to at least one fuel channel. Then at block S82, a plurality of groups of mixing units is disposed at a downstream end of the burner. In some embodiments, each of the plurality of groups of mixing units is arranged coaxially and adjacent to one another, and each group of mixing units comprises at least one fuel channel connected to the at least one fuel pipe and at least one air channel connected to the at least one air pipe.

At block S83, an outlet of the at least one fuel channel and an outlet of the at least one air channel are arranged, such that the outlet of the at least one fuel channel and the outlet of the at least one air channel are angled relative to one another. At block S84, during the operations of the burner, the air and fuel are supplied from an air source and a fuel source to the at least one air pipe and the at least one fuel pipe, respectively. When the air and fuel flow through the air pipe and fuel pipe, they enter into each group of the plurality of groups of mixing units stage-by-stage, through which the air and fuel are mixed, thereby achieving multiple-stage mixing of the air and the fuel.

As previously described, in some embodiments, the plurality of groups of mixing units is disposed vertically along a central longitudinal axis of the burner. In some instances, each group of mixing units may comprise a plurality of fuel channels, a plurality of air channels or a combination thereof. For example, the plurality of groups of mixing units may comprise a first group of mixing units and a second group of mixing units. In some instances, the plurality of groups of mixing units may further comprise a third group of mixing units. These groups of mixing units can be arranged on a firing plate with multiple stages. In some embodiments, the stages may comprise three stages, i.e., a first stage, a second stage, and a third stage.

In some instances, when the multiple stages are two stages, i.e., the first stage and the second stage, then the firing plate may have a configuration as previously shown in FIGS. 5, 6, 7A and 7B. In other instances, when the multiple stages are three stages, i.e., the first stage, the second stage and the third stage, then the firing plate may have a configuration as previously shown in FIGS. 1-3, 4A and 4B. Therefore, any descriptions made before with respect to the firing plate can be equally applicable to the firing plate as discussed with respect to FIG. 8.

Below is a table showing increased energy-saving rates obtained using the burner in accordance with the embodiments of the present disclosure, as compared to a conventional burner.

| Improved energy-saving rate | Oxygen content | | | |
|---|---|---|---|---|
| | 1% $O_2$ | 2% $O_2$ | 3% $O_2$ | 4% $O_2$ |
| Liquefied petroleum gas | 30% | 25% | 20% | 15% |
| Natural gas | 28% | 23% | 20% | 12% |
| Manufactured gas | 25% | 20% | 18% | 10% |

The conventional burner herein can be a burner that has a fuel channel with one or more discharge outlets at the end thereof and an air channel. In operation, the air and fuel can be mixed at the discharge outlets of the fuel channel. In other words, the conventional burner herein does not have multiple-stage mixing arrangements as discussed in accordance with the embodiments of the present disclosure.

As shown in the above table, the comparisons are made under given oxygen contents and three types of fuels are utilized for comparison, i.e., liquefied petroleum gas, natural gas and manufactured gas (e.g., coal gas). It can be seen that the burner in accordance with the embodiments of the present disclosure can significantly improve the energy-saving rate as compared to the conventional burner. For example, when the oxygen content in the exhaust gas is 1% in volume percent, the burner in accordance with the embodiments of the present disclosure can improve the energy-saving rate by 30% as compared to the conventional burner when the fuel is the liquefied petroleum gas. Similarly, the burner in accordance with the embodiments of the present disclosure can improve the energy-saving rate by 28% and 25% as compared to the conventional burner when the fuel is the natural gas and manufactured gas, respectively. From the above table, it can be seen that the burner in accordance with the embodiments of the present disclosure can achieve a higher energy-saving rate than the conventional burner, thereby lowering the fuel costs and decreasing the environmental pollution.

Figure 9:
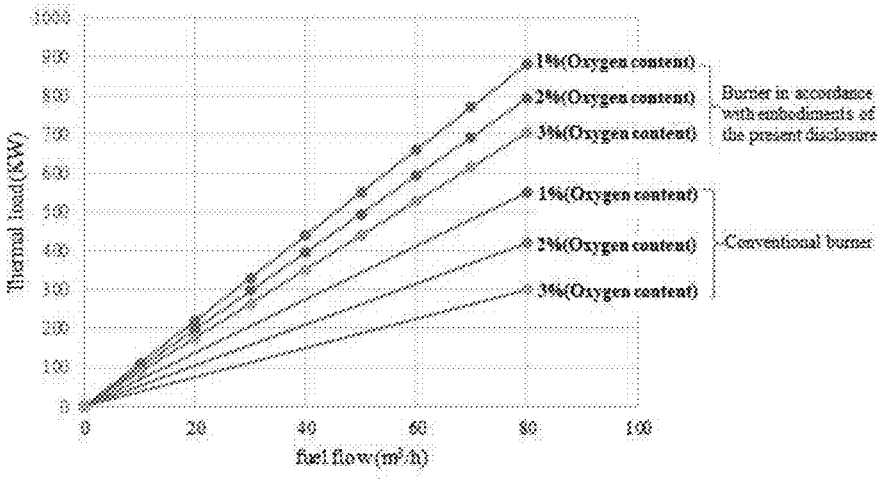
FIG. 9 is a chart of heat loads of natural gas obtained using the burner in accordance with some embodiments of the present disclosure, as compared to a conventional burner.

FIG. 9 is a chart of heat loads of natural gas obtained using the burner in accordance with some embodiments of the present disclosure, as compared to the conventional burner. As seen from FIG. 9, when the fuel flow and the oxygen content are the same, the heat load of the natural gas generated using the burner in accordance with the some embodiments of the present disclosure is significantly greater than the head load of the natural gas generated using the conventional burner. For example, when the fuel flow is at 80 cubic meters/hour ($m^3$/h) and the oxygen content is 3%, the heat load generated using the conventional burner reaches 300 kilowatts (kWs). However, the heat load generated using the burner in accordance with the embodiments of the present disclosure reaches 700 kWs. In other words, the heat load obtained using the burner of the present disclosure is more than twice greater than that obtained using the conventional burner. Similarly, when the fuel flow is at 80 $m^3$/h and the oxygen content is 2%, the heat load generated using the conventional burner reaches nearly 420 kWs. However, the heat load generated using the burner in accordance with the embodiments of the present disclosure reaches nearly 800 kWs. It is apparent to those skilled in the art that the heat load achieved using the burner of the present disclosure is significantly greater than the conventional burner, leading to higher combustion efficiency, combustion temperature, and efficient heating.

Figure 10:
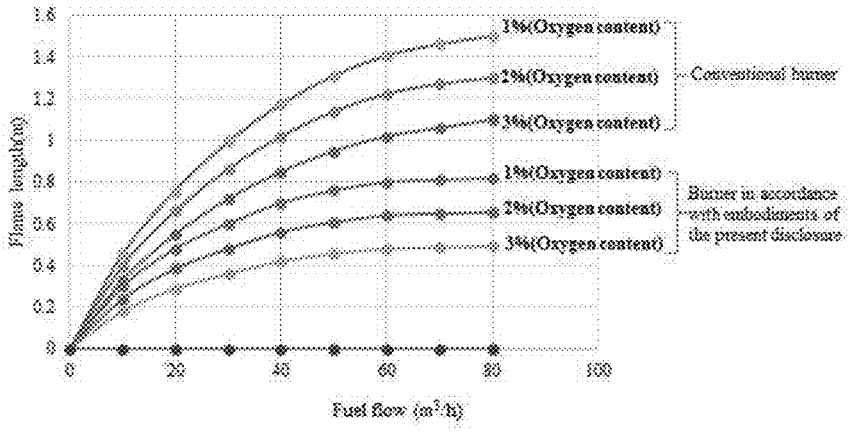
FIG. 10 is a chart of relationships of flame lengths and fuel flow using the burner in accordance with some embodiments of the present disclosure, as compared to the conventional burner.

FIG. 10 is a chart of relationships of flame lengths and fuel flow rate obtained using the burner in accordance with some embodiments of the present disclosure, as compared to the conventional burner. Through multiple experimental measurements and comparisons, it can be seen that a flame length generated using the burner in accordance with the embodiments of the present disclosure is shorter than a flame length generated using the conventional burner when the fuel flow is the same for both types of burners. For example, when the fuel flow is at 60 $m^3$/h, the flame lengths generated using the burner in accordance with the embodiments of the present disclosure are shorter than those generated using the conventional burner regardless of the oxygen content. In particular, when the oxygen content is 1%, the burner in accordance with the embodiments of the present disclosure can generate a flame length of 0.8 meter (m) while the conventional burner can generate a flame length of 1.4 m. It is apparent that the flame length achieved using the conventional burner is much longer than the flame length achieved using the burner in accordance with the embodiments of the present disclosure. As is known to those skilled in the art, a flame length may embody or reflect combustion intensity and a shorter flame length means higher combustion temperature and combustion intensity. It can be understood that the mixing effect created using the burner in accordance with the embodiments of the present disclosure allows complete combustion to occur with a fairly short flame length.

It is to be understood that the components of the burner can be arranged in any suitable configuration. For example, one or more of the components of the burner can be located on different locations based on the design requirements. Further, as used herein A and/or B encompasses one or more of A or B, and combinations thereof such as A and B. It will be understood that although the terms "first," "second," "third" etc. may be used herein to describe various elements, components, regions and/or sections, these elements, components, regions and/or sections should not be limited by these terms. These terms are merely used to distinguish one element, component, region or section from another element, component, region or section. Thus, a first element, component, stage, group, region or section discussed below could be termed a second element, component, region or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom," "inner" or "outer," and "upper" or "top" may be used herein to describe one element's relationship to other elements as illustrated in the figures. It will be understood that relative terms are intended to encompass different orientations of the elements in addition to the orientation depicted in the figures. For example, if the element in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the element in one of the figures were turned over, elements described as "below" or "beneath" other elements would then be oriented "above" the other elements. The exemplary terms "below" or "beneath" can, therefore, encompass both an orientation of above and below.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. Numerous different combinations of embodiments described herein are possible, and such combinations are considered part of the present disclosure. In addition, all features discussed in connection with any one embodiment herein can be readily adapted for use in other embodiments herein. It is intended that the following claims define the scope of the invention and that methods and structures within the scope of these claims and their equivalents be covered thereby.

What is claimed is:

1. A burner, comprising:

at least one air pipe;

at least one fuel pipe;

a plurality of groups of mixing units disposed at a downstream end of the burner, wherein the plurality of groups of mixing units are positioned along a central longitudinal axis of the burner and separated with respect to one another in a direction perpendicular to the central longitudinal axis of the burner, wherein each of the plurality of groups of mixing units is arranged coaxially and adjacent to one another, and each group of mixing units comprises at least one fuel channel connected to the at least one fuel pipe and at least one air channel connected to the at least one air pipe, wherein an outlet of the at least one fuel channel and an outlet of the at least one air channel are angled relative to one another such that fuel flowing out of the outlet of the at least one fuel channel is mixed with air flowing out of the outlet of the at least one air channel, thereby achieving multiple-stage mixing of the air and the fuel, wherein each group of mixing units comprises a plurality of fuel channels, a plurality of air channels or a combination thereof, wherein the plurality of groups of mixing units comprises a first group of mixing units and a second group of mixing units, wherein the first group of mixing units and the second group of mixing units are arranged on a firing plate with three stages, and wherein the three stages comprise a first stage, a second stage and a third stage, wherein the first group of mixing units comprises a first plurality of air channels arranged on the first stage of the firing plate and a first plurality of fuel channels arranged on the second stage of the firing plate, and a central longitudinal axis of each of the first plurality of air channels is angled relative to a central longitudinal axis of a corresponding one of the first plurality of fuel channels, and wherein the second group of mixing units comprises a second plurality of air channels arranged on the second stage of the firing plate and a second plurality of fuel channels arranged on the third stage of the firing plate, and a central longitudinal axis of each of the second plurality of air channels is angled relative to a central longitudinal axis of a corresponding one of the second plurality of fuel channels, wherein each of the second plurality of air channels is further arranged to be a passage passing through the first and second stages of the firing plate to connect with the at least one air pipe.

2. The burner of claim 1, wherein the central longitudinal axis of each of the first plurality of air channels is angled relative to the central longitudinal axis of the corresponding one of the first plurality of fuel channels ranging from approximately 45 degrees to 120 degrees.

3. The burner of claim 1, wherein the first plurality of air channels is arranged circumferentially around the first stage of the firing plate.

4. The burner of claim 1, wherein the first plurality of fuel channels is arranged to be radially outwardly extended from a central longitudinal axis of a burner body.

5. The burner of claim 1, wherein the central longitudinal axis of each of the second plurality of air channels is angled relative to the central longitudinal axis of the corresponding one of the second plurality of fuel channels at a degree ranging from approximately 45 degrees to 120 degrees.

6. The burner of claim 1, wherein the second plurality of fuel channels is arranged circumferentially around a periphery of the third stage of the firing plate.

7. The burner of claim 1, wherein the first plurality of fuel channels is arranged to be radially outwardly extended from a central longitudinal axis of a burner body.

8. The burner of claim 1, wherein a cross section of an outlet of each of the first plurality of air channels is circular and a radius of the outlet is equal to a vertical distance of a bottom surface of the air channel to an outer edge of the second stage of the firing plate.

9. The burner of claim 1, wherein a cross section of an outlet of each of the second plurality of fuel channels is circular and a radius of the outlet is equal to a vertical distance of a bottom surface of each air channel on the second stage to an outer edge of the third stage of the firing plate.

10. The burner of claim 1, wherein a total sectional area of the air channels on the first stage of the firing plate accounts for approximately 50%~80% of a total sectional area of all the air channels on the three stages of the firing plate.

11. The burner of claim 1, further comprising a burner housing configured to encompass the plurality of groups of mixing units inside of the burner.

12. The burner of claim 11, further comprising a convergent nozzle arranged ahead of the plurality of groups of mixing units, wherein the convergent novel is configured to converge a flame generated at a mixing zone and eject it out of the burner.

13. The burner of claim 12, wherein a convergence angel of the convergent nozzle with respect to the central longitudinal axis of the burner body is ranging from 20 degrees to 70 degrees.

14. The burner of claim 13, wherein refractory material is filled between an outer surface of the convergent nozzle and an inner surface of the burner housing.

15. The burner of claim 1, further comprising a third group of mixing units, wherein the first group of mixing units, the second group of mixing units and the third group of mixing units are arranged on a firing plate with three stages, wherein the third group of mixing units comprises a first plurality of air channels arranged on the third stage of the firing plate and a first plurality of fuel channels arranged on the second stage of the firing plate, and a central longitudinal axis of each of the first plurality of air channels is angled relative to a central longitudinal axis of a corresponding one of the first plurality of fuel channels.

16. The burner of claim 15, wherein the first plurality of air channels of the third group of mixing units is replaced by the at least one fuel pipe or a portion thereof at the center of the burner body.

17. The burner of claim 1, wherein the first plurality of air channels is evenly or unevenly spaced around a periphery of the first stage of the firing plate.

18. The burner of claim 1, wherein the number of the first plurality of fuel channels is proportional or disproportional to the number of the first plurality of air channels.

* * * * *